United States Patent [19]

Fruge et al.

[11] Patent Number: 4,816,384

[45] Date of Patent: Mar. 28, 1989

[54] POWDERED PACKAGED DEVELOPER

[75] Inventors: Daniel R. Fruge, Wilmington; Peter K. Sysak, Hockessin, both of Del.

[73] Assignee: E. I. Du Pont de Nemours and Company, Wilmington, Del.

[21] Appl. No.: 917,057

[22] Filed: Oct. 9, 1986

[51] Int. Cl.[4] ..... G03C 5/24; G03C 1/02

[52] U.S. Cl. ..... 430/465; 430/435; 430/438; 430/464; 430/468

[58] Field of Search ..... 430/465, 435, 438, 464, 430/468

[56] References Cited

U.S. PATENT DOCUMENTS

| | | | |
|---|---|---|---|
| 2,162,765 | 10/1937 | Tarnoff | 430/465 |
| 2,172,216 | 9/1939 | Miller | 430/465 |
| 2,384,592 | 9/1945 | Bean | 430/465 |
| 2,751,687 | 6/1956 | Colton | 34/5 |
| 3,867,151 | 2/1975 | Katz | 430/465 |
| 4,022,621 | 5/1977 | Hayashi et al. | 430/465 |
| 4,598,040 | 7/1986 | Netz et al. | 430/465 |

*Primary Examiner*—Mukund J. Shah

[57] ABSTRACT

A storage stable and rapid dissolving packaged powder developer of uniform composition is produced by preparing developer or developer precursor solutions and removing solvent to provide powder for packaging in plastic impervious to the atmosphere. Preferably, the solvent is removed by freeze-drying or spray-drying.

2 Claims, No Drawings

POWDERED PACKAGED DEVELOPER

FIELD OF THE INVENTION

The present invention relates to powdered, packaged developer compositions which can be rapidly dissolved to provide a working strength developer and processes for their preparation. More particularly, the compositions are prepared by freeze or spray drying of liquid developer solutions.

BACKGROUND OF THE INVENTION

Developers for silver halide films are conventionally prepared from solid ingredients such as hydroquinone, sodium carbonate, sodium bisulfite, potassium bromide, etc. Thus, it is apparent that solid mixtures of appropriate ratios of these ingredients can be converted into working strength developers simply by mixing them in water. In fact, 30 years ago most developers were sold as powders, but long mixing times were required to prepare aqueous solutions for use.

Such powders do not offer the ease of preparation and reproducible results required to meet the needs of small businesses and private practitioners. Today, most developers are sold as liquid concentrates which are easy to mix with water to prepare working strength developers. These concentrates, however, have a relatively short shelf life and the cost of shipment includes the weight of water in the concentrates. Thus, up to the time of the present invention, a real need existed to provide a storage-stable, solid composition which can be readily dissolved to provide a developer which is equivalent in performance to liquid developers and which are more conveniently and economically employed in larger scale operations such as printing shops and hospitals.

Developing agents are known from publications such as Lee and Brown, "The Developing Agents and their Reactions, " The Theory of the Photographic Process, ed. T. H. James, 4th ed., Macmillan, N.Y. (1977), Chapter 11.

Yet, in spite of all that was known about developers in the art, there was no suggestion of how existing techniques could be utilized as described herein to prepare a rapidly dissolving, powdered photographic developer.

SUMMARY OF THE INVENTION

According to the present invention there is provided a process for preparing a dry powder photographic developer comprising:

a. preparing a liquid photographic developer solution consisting essentially of a solvent containing a developing amount of at least one active solid component and an alkali source other than hydroxide;

b. removing the solvent to obtain a powder;

c. packaging the powder to preclude contact with the atmosphere.

A particularly preferred process according to the present invention comprises:

a. preparing an aqueous solution of a developer precursor containing an alkali source other than hydroxide;

b. preparing a developer precursor solution of at least one active solid developing agent;

c. removing the water from the solution formed in step a. and the solvent from the solution formed in step b. to obtain powders having an average particle size less than about 100 micrometers;

d. combining the two powders obtained in step c. in proportions that will prepare a developing strength liquid photographic developer upon addition of water; and e. packaging the combined powders to preclude contact with the atmosphere.

Also provided is a powder suitable for the preparation of a liquid photographic developer upon the addition of water consisting essentially of (a) particles of at least one of hydroquinone or chlorohydroquinone, either alone or in combination with a solid secondary developer, at least one antifoggant or both, said particles having an average particle size less than about 100 microns; and (b) particles of a solid alkali other than hydroxide having an average particle size less than about 100 micrometers, said mixture dissolving in enough water to make a working strength developing solution in less than about fifteen minutes.

DETAILED DESCRIPTION OF THE INVENTION

It has been discovered that packaged powder developers particularly useful for low volume applications, such as private practice physicians, can be prepared by freeze and spray drying techniques. It has been found that the powders made by removing solvent from a complete developer or from precursor solutions comprise particles having an average particle size less than about 100 micrometers which dissolve more rapidly than mixtures of the original ingredients. The uniform nature of powders and/or mixtures of powders prepared according to the present invention is believed to provide better dissolution versus prior art powder developers.

Any conventional, active solid developer can be used in practicing the present invention; however, at least one of hydroquinone or chlorohydroquinone alone of in combination with a secondary developer are preferred. Such secondary developers as metol, phenidone or dimezone S are preferred. When secondary developers are used. they are employed at a concentration of about 1 to 10% of the molar quantities of the primary developer. A listing of other solid developers and secondary developers can be found in Lee and Brown, supra, etc.

Developing solutions frequently contain additional ingredients for particular purposes, e.g., antifoggants, preservatives, and metal complexing agents. These additional ingredients can be employed in the present invention as long as they are solids. Particularly preferred additional ingredients are antifoggants such as sodium or potassium bromide, benzotriazole, phenylmercaptotetrazole and 5-nitroindazole. Other ingredients are preservatives such as sodium or potassium sulfite, sodium or potassium metabisulfite or ascorbic acid; and metal complexing agents such as ethylenediaminetetraacetic acid or its sodium salts. For lithographic developers which must maintain a low sulfite concentration, ingredients such as paraformaldehyde, sodium formaldehyde bisulfite and sodium glutaraldehyde bisulfite may be used.

Water and a commercially available alcohol such as ethanol are best suited to serve as solvents for the present invention, with water being preferred. Generally, the solvent can be about 80 to 100% by volume of water and about 20 to 0% by volume of ethanol. However, in some cases where a developing agent is to be prepared as a separate solution from a caustic one, it may be advantageous to employ higher percentage amounts of alcohol or some less common solvent such as glacial acetic acid or pyridine. Other solvents which can be used are aromatics such as benzene, toluene and the like; and chlorinated solvents such as methylene chloride, chloroform and the like. The nature of the solvent is not unique to the practice of the present invention, but simply provides a homogeneous environment for the developer components prior to solvent removal to produce the desired powder.

It has been discovered that hydroxy alkaline compounds such as potassium and sodium hydroxide are not suitable for the process of the present invention since storage stable compositions are not obtained. As a result, the alkaline materials suitable for this process can be any solid alkali source other than hydroxide and include alkali metal carbonates and bicarbonates such as sodium carbonate, potassium carbonate, sodium bicarbonate, potassium bicarbonate and equivalent lithium and ammonium salts. Sodium carbonate and potassium carbonate are preferred at a concentration in the developer solution of about 2 to 20% by weight of total solids.

Freeze drying or spray drying as used herein can be carried out according to standard procedures. Trade and patent publications describe the use of freeze-drying for various uses such as instant coffee manufacture. Similarly, techniques for spray-drying are known such as from K. Masters, SPRAY DRYING, 2nd ed., John Wiley & Sons, New York (1976). These techniques can be used in the present invention. For example, freeze drying can employ a wide range of vacuum pressures and temperatures. Typical vacuum pressure ranges are 10–100 millitorr. During drying, the frozen developer solution can be subjected to ambient temperatures (e.g., 20°–30° C.) or can be heated to increase the drying rate. The level of heating is limited only in that the developer solution must remain frozen during drying. Water is the preferred solvent for freeze drying.

Spray drying can employ a variety of equipment configurations. A preferred configuration, especially when drying solutions containing solvents other than water, is of the closed cycle type with an inert gas such as nitrogen or argon as the drying medium. The drying temperature at the dryer's inlet and in the drying chamber is the most critical factor and should be less than 200° C. preferably between 50° and 130° C. For spray drying, water or a mixture of water and ethanol is the preferred solvent.

Packaging materials useful for the present invention can be any air and water imprevious materials and include resin coated polyethylene, polypropylene, polyethylene terephthalate and cellulose triacetate. Polyethylene terephthalate is preferred. Adhesive or heat seal techniques can be employed to exclude contact with the atmosphere once the freeze or spray dried powder has been placed in such a plastic pouch, bag or plastic lined container. Packaging to preclude contact with the atmosphere can be carried out under a nitrogen or other inert atmosphere; but, this can be eliminated if packaging is done quickly.

The following Examples serve to illustrate the practice of the present invention in which parts and percentages are by weight unless otherwise indicated.

EXAMPLE 1

FREEZE DRIED HYDROQUINONE DEVELOPER

A 250-ml aqueous solution was made containing the following components:

12.40 g sodium carbonate anhydrous
15.00 g sodium sulfite
1.00 g potassium bromide
5.63 g hydroquinone Freeze drying this solution in a laboratory flask freeze dryer at room temperature and 10 militorr average pressure resulted in 35.9 g of white powder. When water was added, with stirring, to this powder to make a 250-ml solution, the powder dissolved in 4 minutes.

As a control, a powder mixture containing the same amounts of the above components was prepared. When water was added, with stirring, to this mixture to make a 250-ml solution, the powder dissolved in 7 minutes. This shows that a freeze dried powder dissolves faster than a normally prepared powder even in developer formulations containing only components with a high degree of solubility.

Developing Du Pont Cronex® 7 Medical X-Ray Film in the solution made from freeze dried powder resulted in similar sensitometry as compared to development in solution made from the control.

EXAMPLE 2

FREEZE DRIED METOL-HYDROQUINONE DEVELOPER

The following components were dissolved to make a 250-ml aqueous developer solution:

11.25 g sodium carbonate monohydrate
16.25 g sodium sulfite
0.88 g potassium bromide
0.50 g metol (N-methylaminophenol)
6.50 g hydroquinone Freeze drying according to Example 1 resulted in 34.6 g of white powder. When water was added, with stirring, to this powder to make 250-ml solution, 2.5 minutes was required for the powder to dissolve.

As a control, a powder mixture containing the same amounts of the above components was prepared. When water was added, with stirring, to this mixture to make 250-ml solution, most of the powder dissolved within 3 minutes. The remainder, mostly metol, remained suspended after 30 minutes of stirring and dissolved only after warming the solution to 40° C.

Developing Du Pont Cronex® 7 Medical X-Ray Film in the solution made from freeze dried powder resulted in similar sensitometry as compared to development in solution made from the control.

EXAMPLE 3

FREEZE DRIED POWDER WITH ANTIFOGGANTS

A developer solution was made containing the following components, per liter:

45.00 g sodium carbonate monohydrate
65.00 g sodium sulfite
3.50 g potassium bromide
25.00 g hydroquinone
1.80 g Dimezone S 0.050 g Benzotriazole was dissolved in 1.0 g ethanol. The benzotriazole solution was added to 250 ml of the developer solution and freeze dried as in Example 1 to make 33.4 g of powder.

Similarly, 0.010 g phenylmercaptotetrazole was dissolved in 1.0 g ethanol. The phenylmercaptotetrazole solution was added to 250 ml of the developer solution and freeze dried as in Example 1 to make 33.5 g powder.

As controls, two batches of a powder mixture containing enough of each of the above developer components to make 250 ml of the developer solution were prepared. To one batch, 0.050 g benzotriazole was added and mixed; to the other, 0.010 g phenylmercaptotetrazole was added and mixed.

Water was added, with stirring, to the freeze dried and control powders to make 250-ml solutions. While 15 minutes were required to dissolve both control powders, only 2–3 minutes were required to dissolve the freeze dried powders.

Developing Du Pont Cronex® 7 Medical X-Ray Film in the solution made from freeze dried powder resulted in similar sensitometry as compared to development with the appropriate control.

To demonstrate the freeze drying of solutions containing 5-nitroindazole, which is significantly less soluble in water than benzotriazole or phenylmercaptotetrazole, and, in addition, to demonstrate freeze drying the poorly soluble Dimezone S developing agent, 250 ml of a developer solution was prepared containing:

11.25 g sodium carbonate monohydrate
16.25 g sodium sulfite
0.88 g potassium bromide
6.25 g hydroquinone
0.50 g Dimezone S To this solution was added 2.5 g of a 1:9 water: ethanol solution containing 0.030 g 5-nitroindazole. The resulting solution was freeze dried as in Example 1 to obtain 33.0 g powder.

As a control, a powder mixture containing the same amounts the above components was prepared.

Water was added, with stirring, to the freeze dried and control powders to make 250-ml solutions. In the case of the control powder, all of the inorganic components and the hydroquinone dissolved within 4 minutes. The Dimezone S dissolved within 15 minutes, but a significant amount of the 5-nitroindazole remained suspended in the solution. In the case of the freeze dried powder, all components except the 5-nitroindazole dissolved within about 4 minutes. The 5-nitroindazole remained dispersed as very fine particles, much smaller than that observed in the control. Surprisingly, these particles dissolved within 15 minutes. This experiment showed that easily dissolved dispersions of otherwise poorly soluble developer components can be prepared through freeze drying.

While the powder mixtures had a very nonuniform appearance due to the different particle sizes and degree of crystallinity of the different components, the freeze dried powder had a very uniform appearance. Optical microscopy of the freeze dried powder also indicated a uniform appearance among individual particles. Individual particle size was difficult to measure due to the formation of irregularly shaped agglomerates.

Developing Du Pont Cronex® 7 Medical X-Ray Film in the solution made from freeze dried powder resulted in similar sensitometry as compared to development in solution made from the appropriate control. For the film developed in the solution made from freeze dried powder, fog was slightly lower due to the higher level of dissolved 5-nitroindazole.

EXAMPLE 4

SPRAY DRIED HYDROQUINONE DEVELOPER

An aqueous developer solution was made containing the following components, per liter:

2.00 g sodium (tetra) ethylenediaminetetraacetate
3.50 g potassium bromide
33.00 g sodium sulfite
25.00 g hydroquinone
141.70 g sodium carbonate monohydrate To 2.0 ml of warm glacial acetic acid (40°–49° C.), 1.80 g Dimezone S, 0.156 g 5-nitroindazole and 0.195 g benzotriazole were dissolved. This solution was added to the developer solution above. 300 milliliters of this solution was reserved as a control.

300 mL of the resulting developer solution was spray dried in a laboratory open cycle spray dryer with an electrically heated inlet maintained at 125° C. The dried powder was a light beige in color and, when dissolved in 300 ml water, gave a light brown color. The slight discoloration may have arisen from a small degree of developer oxidation during drying.

Developing Du Pont Cronex® 7 Medical X-Ray Film in the solution made from the spray dried powder resulted in only slightly slower speed and lower density as compared to development with the control developer.

EXAMPLE 5

SPRAY DRIED DEVELOPER - TWO PART POWDER

To reduce degradation during spraying in a spray dryer, two solutions were prepared.

Part 1 contained, per liter of aqueous solution:

100 g sodium carbonate monohydrate
4 g sodium(tetra) ethylenediaminetetraacetate
130 g sodium sulfite
7 g potassium bromide Part 2 contained, per liter of a 1:19 water:ethanol by volume solution:

132 g hydroquinone
10 g Dimezone S
1 g benzotriazole
0.9 g 5-nitroindazole

The two solutions were separately spray dried in a closed cycle spray dryer under a nitrogen atmosphere (2-3% oxygen was present). The dryer's inlet temperature was maintained at 100°–110° C. The resulting powder from each Part was white and showed better stability in air than the powder prepared from an aqueous solution containing all ingredients. Microscopic examination showed that the powder consisted of mainly spherical particles. Median particle diameter as measured by laser scattering was 30 micrometers, with ten percent of the particles less then 10 micrometers and ninety percent less than 94 micrometers. Small amounts of irregularly shaped particles were observed. When 30.1 grams of the powder made from Part 1 and 6.81 grams of the powder made from Part 2 were blended together and stirred into 250-ml of water, complete dissolution occurred within 10 minutes. Solution color was similar to that of the normally prepared developer.

EXAMPLE 6

FREEZE DRIED LITHO DEVELOPER

A 250-ml aqueous solution was prepared containing the following components:
15.00 g sodium sulfite
1.25 g potassium metabisulfite
3.75 g boric acid (crystals)
0.75 g potassium bromide
3.75 g paraformaldehyde
11.25 g hydroquinone Freeze drying the solution as in Example 1 resulted in 35.9 grams of powder which, when stirred into water to make a 250 ml solution, dissolved within two minutes. When the same amount of water was added to a powder mixture of the components listed above, a white cloudy dispersion formed which gradually cleared. Total dissolution occurred after 37 minutes.

Developing suitably exposed Du Pont Cronar® Ortho S Litho Film in the solution made from the above freeze dried powder resulted in similar sensitometry as compared to development in solution made from the control solution.

EXAMPLE 7

FREEZE DRIED DEVELOPER WITH ASCORBIC ACID PRESERVATIVE

A 250-ml aqueous solution was prepared containing the following components:
30.00 g sodium carbonate anhydrous
15.00 g ascorbic acid
0.88 g potassium bromide
6.25 g hydroquinone
0.45 g Dimezone S Freeze drying the above solution as in Example 1 produced 53 grams of powder which, when stirred into water to make 250 ml of solution, dissolved in 5 minutes. As a control, a powder mixture was prepared with the above composition. When water was added to the mixture, heavy foaming occurred and resulted in loss of solution. Apparently the ascorbic acid dissolved faster than the sodium carbonate, initially keeping the pH low enough for carbon dioxide to evolve. By contrast, no foaming occurred when water was added to the freeze dried powder, presumably because the ascorbic acid had been converted to the ascorbate when preparing the solution for freeze drying.

As an alternative control, a powder mixture of the above composition, except without ascorbic acid, was made. After adding water to make 250 ml of solution, with stirring, the appropriate amount of ascorbic acid was added over a thirty second interval. This resulted in only a small amount of foaming. All components but the Dimezone S dissolved in 5 minutes. Total dissolution occurred after 17 minutes.

This example shows a particular advantage to using dried powders of this invention over powder mixtures. A powder developer which has not been freeze dried or spray dried such as that shown in this example would have to be reformulated or packaged in two parts and mixed in sequence.

Developing suitably exposed Du Pont Cronex® 7 Medical X-Ray Film in the solution made from freeze dried powder resulted in similar sensitometry as compared to development in solution made from the control.

EXAMPLE 8

HYDROXIDE VS CARBONATE IN DEVELOPER

A stock aqueous solution was made containing, per liter:
2.00 g sodium(tetra) ethylenediaminetetraacetate
35.00 g sodium sulfite
3.50 g potassium bromide
25.00 g hydroquinone
1.50 g Phenidone
0.20 g benzotriazole
0.16 g 5-nitroindazole Sodium carbonate monohydrate was dissolved in 500 ml of the stock solution to adjust the solution to pH 10.0. As comparison, a 50% solution of potassium hydroxide was made and likewise added to the remaining 500 ml of the stock solution to adjust the solution to pH 10.0. The carbonate-containing solution when freeze dried as in Example 1 yielded a white powder. This powder when exposed to air remained white for about an hour, after which it turned slightly pink, indicating oxidation of the developer. The solution containing potassium hydroxide when similarly freeze dried yielded a nonuniform yellow-green powder which darkened dramatically when exposed to air for twenty minutes. While packaging the carbonate-containing powder in heat-sealable polyethylene terephthalate bags resulted in a stable powder, this method did not prevent the potassium hydroxide-containing powder from degrading. Sealing the potassium hydroxide-containing powder in glass jars under nitrogen also did not prevent degradation.

What is claimed is:

1. A powder suitable for the preparation of a liquid photographic developer upon the addition of water consisting essentially of (a) particles of at least one of hydroquinone or chlorohydroquinone, either alone or in combination with a solid secondary developer, at least one antifoggant, or both, said particles having an average particle size less than about 100 microns; and (b) particles of a solid alkali other than hydroxide having an average particle size less than about 100 microns, said mixture dissolving in enough water to make a working strength developing solution in less than about 15 minutes.

2. The powder of claim 1 wherein the solid alkali particles are sodium or potassium carbonate.

* * * * *